United States Patent [19]

Blonski

[11] 4,254,543

[45] Mar. 10, 1981

[54] METHOD OF MAKING FORESTAY CONNECTOR

[75] Inventor: Paul Blonski, Brecksville, Ohio

[73] Assignee: Hyde Products, Inc., Westlake, Ohio

[21] Appl. No.: 13,248

[22] Filed: Feb. 21, 1979

[51] Int. Cl.³ ..... B21D 39/00; B23P 11/00

[52] U.S. Cl. ..... 29/517; 29/526 R; 114/106; 403/274

[58] Field of Search ..... 29/517, 526 R, 522 R; 403/274, 285; 114/102, 104–108

[56] References Cited

U.S. PATENT DOCUMENTS

| | | | |
|---|---|---|---|
| 206,321 | 7/1878 | Heaton | 403/274 |
| 727,759 | 5/1903 | Double et al. | 403/274 |
| 1,643,110 | 9/1927 | Briggs | 29/517 X |
| 1,908,600 | 5/1933 | Green et al. | 29/517 X |
| 2,060,864 | 11/1936 | Hedler | 403/274 |
| 2,357,733 | 9/1944 | Guderian | 29/517 X |
| 3,262,724 | 7/1966 | MacRobbie | 403/285 |
| 3,583,060 | 6/1971 | Sigmans | 29/517 |
| 3,611,969 | 10/1971 | Hood | 114/106 |
| 3,851,608 | 12/1974 | Stearn | 114/105 |
| 3,958,523 | 5/1976 | Holmes et al. | 114/106 |

*Primary Examiner*—Charlie T. Moon
*Attorney, Agent, or Firm*—Yount & Tarolli

[57] ABSTRACT

An improved stay includes an aluminum rod member. A terminal fitting located at each end of the rod member connects the rod member with the sailboat. The connection between the rod member and the terminal fitting is made by deforming a stainless steel sleeve member into the aluminum forestay rod member. The sleeve member is provided with internal grooves or recesses. The sleeve member is deformed radially inward and cold forms the aluminum into tight engagement with the grooves. The stay may be used as a forestay. In this case, the rod member has an axially extending slot in which the bead of a sail is received. Further the terminal fittings may include a swivel which permits the rod member to be rotated to furl the sail.

11 Claims, 5 Drawing Figures

METHOD OF MAKING FORESTAY CONNECTOR

BACKGROUND OF THE INVENTION

The present invention relates to a stay assembly and to a method of making a stay assembly for use in a sailboat. In particular the present invention relates to a stay unit which includes a metal stay rod having a collar on the rod which is to be connected with a terminal fitting at one end of the stay rod.

Sailboats utilize stay assemblies connected between the top of the mast and the hull of the boat respectively to support the mast. One type of assembly includes a stay rod which has collars thereon to connect the rod to fittings at each end of the rod which in turn are connected to the mast or hull. One of the problems in a stay assembly utilizing a stay rod is to provide a connection which is sufficiently strong between the stay rod, normally an aluminum rod, and the terminal fittings at each end of the rod. Conventionally, the terminal fittings have been formed of stainless steel and collars of stainless steel have been threaded onto the aluminum stay rod to form a connection to the terminal fittings. For a number of reasons this connection has not proved entirely satisfactory.

In addition each stay must be individually fitted to the boat on which it is to be installed. In conventional practice one or both of the collars for connecting the rod to the terminal fittings have been left disconnected from the stay rod when the stay assembly has been shipped from the factory to a dealer. The dealer or installer then has cut the stay rod to the exact length required and connected the remaining terminal fitting or fittings to the rod. Difficulties have been encountered in making threaded connections between the terminal fittings and the stay rod in the field.

SUMMARY OF THE INVENTION

The present invention provides a new and improved rod-type stay assembly connected to terminal fittings at its opposite ends. At each end of a stay rod a collar is disposed about the stay rod, and connects the rod with a terminal fitting. A sleeve on the stay rod and inside the collar forms a stop abutment for the collar. In accordance with a feature of the present invention, the sleeve has its interior surface next to the stay rod and the rod or sleeve is provided with spaced apart ridges extending transverse to the axis of the sleeve and recessed or valley portions adjacent to the ridges with the ridges being indented into the mating rod and the adjacent recessed portions having material therein which has been cold formed by cold forming the sleeve and the rod simultaneously.

In the preferred practice, a tubular sleeve formed of stainless steel is placed around an end portion of the stay rod which is preferably aluminum. The sleeve has spaced apart recesses or grooves on its interior surface and ridges therebetween with the ridges preferably extending transverse to the central axis of the sleeve. The sleeve is swaged radially inwardly to compress its cross section so that the aluminum of the stay rod is indented and cold formed into tight engagement with the recessed portions between the ridges of the sleeve. An annular end surface of the sleeve which extends transverse to the axis of the rod provides an abutment surface against which a shoulder on the inside of the collar bears to transmit tensile loads between the stay rod and the mast or hull of the boat.

BRIEF DESCRIPTION OF THE DRAWINGS

These and other objects and features of the present invention will become clear to those skilled in the art to which it relates upon reading the following description of a preferred embodiment taken together with the accompanying drawings in which.

DESCRIPTION OF PREFERRED EMBODIMENTS

Figures 1, 2, 3, 4, 5:
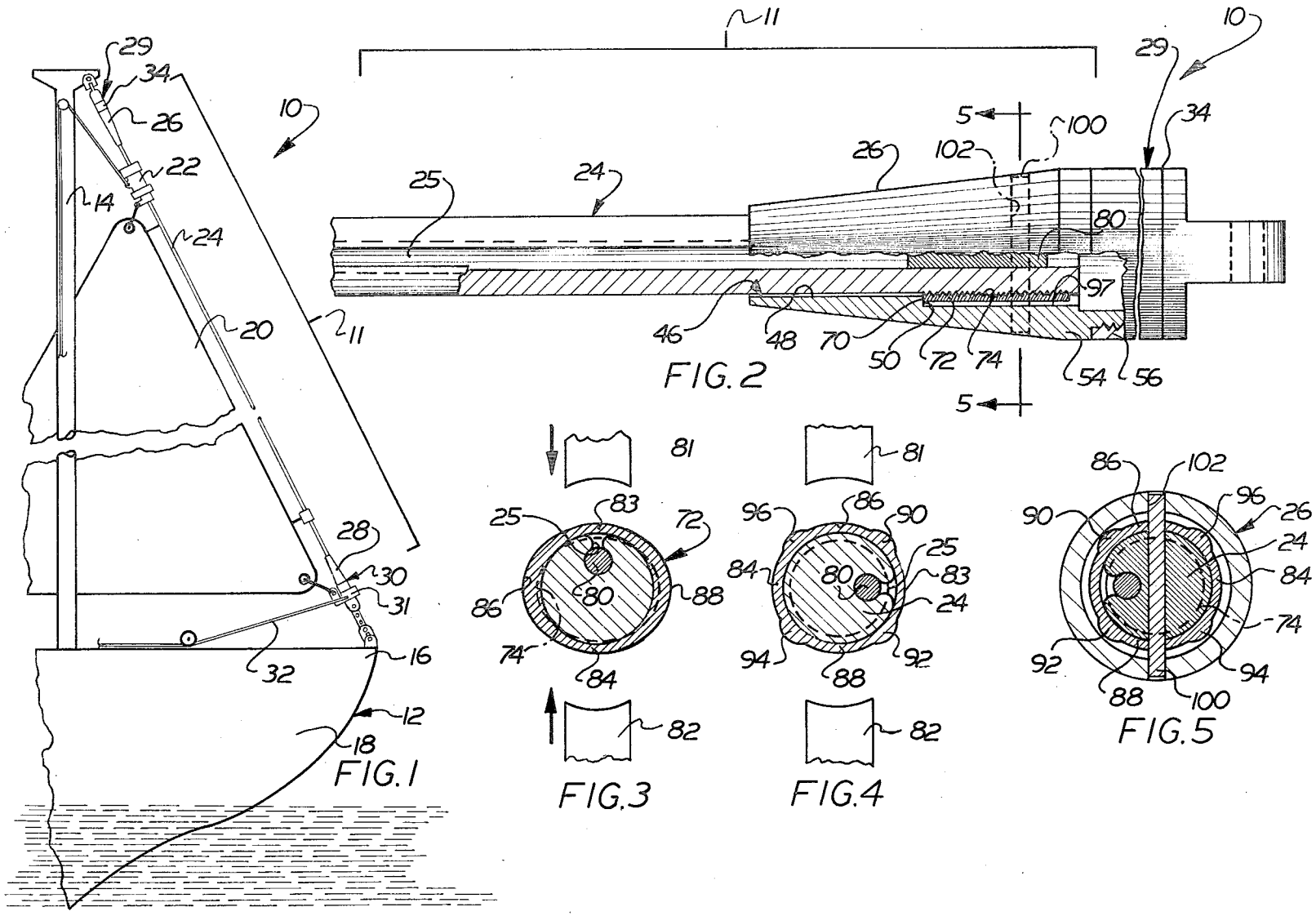
FIG. 1 is a view of a portion of a sailboat furnished with a stay assembly in accordance with the present invention.
FIG. 2 is a partly broken away sectional view of a portion of the stay assembly of FIG. 1 showing a connection between a stay rod and a tapered collar.
FIG. 3 is a sectional view of a stay rod and a sleeve which form a part of the connection shown in FIG. 2 and showing the sleeve after it has been deformed from two sides into engagement with the rod.
FIG. 4 is a view similar to FIG. 3, but showing the sleeve after it has been deformed from four sides into engagement with the rod.
FIG. 5 is a sectional view taken along line 5—5 of FIG. 2.

Referring to FIG. 1, a stay assembly 10 incorporating the present invention is illustrated in position on a sailboat 12 having a mast 14 and a bow portion 16 of a hull 18. Although the following description relates to a forestay 10, it will be appreciated by those skilled in the art that the present invention is equally applicable to stays generally, including sidestays or shrouds, and backstays. The assembly 10 is connected between the top of the mast 14 and the bow 16, and a foresail 20 is connected with a forestay rod 24 of the forestay assembly. A halyard swivel 22 coaxial with a forestay rod 24 serves to raise or lower the sail 20 in a conventional manner.

The forestay assembly 10 includes a forestay unit 11 comprising the forestay rod 24 and tapered collars 26 and 28 at the ends of the rod 24 which are used to connect the rod to terminal fittings 29 and 30 at opposite ends of the assembly. In a preferred embodiment, the rod 24 has a conventional C-shaped slot 25 for receiving the bead (not shown) of the sail 20. (See U.S. Pat. No. 3,851,608). The rod is rotatable to furl the sail 20 and the halyard swivel 22 is operable to raise and lower the sail in a conventional manner. To effect furling of the sail, the forestay assembly 10 includes a conventional furling drum 31 operated by a furling line 32. The lower end of the rod 24 is connected to the furling drum 31 through the collar 28. In addition, the terminal fitting 29 at the upper end of the forestay assembly 10 includes a swivel 34, connected with the tapered collar 26.

In the preferred and illustrated embodiment, the collars 26 and 28 are connected to the forestay rod by a sleeve 72 interlocked on the rod. Since the collars 26, 28 and their sleeve connections are substantially identical, the description will proceed only with respect to the upper collar 26 and its corresponding sleeve 72.

The tapered collar 26 (FIG. 2) on the rod 24 has an axial passage 46 therethrough for receiving the upper end portion of the rod 24. The axial passage 46 of the collar 26 had a reduced diameter at its inner end portion 48 which closely fits the forestay rod 24 and provides a radially extending annular shoulder 50 facing the outer end 54 of the tapered collar 26. The collar 26 has an outer end 54 which is threaded to provide a connection to part of the swivel 34. The tapered collar 26 surrounds a sleeve 72 on the forestay rod, and the internal shoulder 50 of the collar engages the end 70 of a sleeve 72 to prevent the collar from moving over the sleeve 72 and off the rod 24.

In accordance with a feature of the present invention, the sleeve 72 has spaced ridges and adjacent recesses or grooves 74 formed on the inside surface of the sleeve 72. The ridges 74 are indented into the forestay rod 24 and the recesses and grooves are substantially filled by the indenting operation. When the forestay rod 24 is indented, metal will be cold flowed into the recesses or grooves 74, preferably to substantially fill the latter, to produce a high strength connection. The upper end of the slot 25 is preferably plugged by a plug 80 inserted prior to the indenting operation so that the rod metal is cold formed with the plug in place inside the portion of the slot of the rod opposite the dies 81 and 82. The plug 80 during sailing will block water from entering the open end of the slot 25 of the rod 24.

In making the assembly the sleeve 72 is preferably of a hard metal, e.g., a stainless steel such as A.I.S.I. No. 316 and forestay rod 24 is preferably formed of a light weight extruded aluminum alloy, such as A.S.T.M. 6351.

The sleeve 72 as illustrated is generally cylindrical. The interior surface of the sleeve 72 has maximum and minimum internal diameters defining the spaced apart ridges and adjacent recesses or grooves 74 which preferably extend transverse to the central axis of the sleeve.

The grooves and ridges 74 may be parallel, concentric annular grooves, in which case they are preferably spaced approximately 1/32 of an inch apart. However, a single helical thread or groove 74, preferably having a pitch of approximately 32 turns per inch, may provide the alternating series of ridges and recesses on the interior of the sleeve 72.

Of course, other arrangements of ridges, recesses, grooves, or serrations, preferably closely spaced, could be used. For example, the ridges or grooves need not be continuous, but could be interrupted, each one extending around a portion of the interior surface of the sleeve 72. Moreover, interrupted teeth or ridges extending lengthwise of the sleeve 72 may be utilized. However, transversely extending teeth or ridges are preferred.

In the described preferred embodiment, the forestay rod 24 and the sleeve 72 are generally cylindrical. However, the invention is applicable to a variety of cross sections for the sleeve and the rod. For example, the rod 24 may be oval, triangular, or polygonal in cross section. In such a case the sleeve 72 would have a central passage 46 of oval, triangular, or polygonal cross section which corresponds to the outside shape of the rod 24.

After the sleeve 72, the collar 22 and the plug 80 have been assembled to the rod 24, the sleeve is subjected to a pressure to plastically deform the sleeve inwardly to indent the ridges 74 into the rod. Preferably the pressure and indenting is such as to completely fill the grooves with the metal of the rod including metal cold flowed by the indenting operation. To do this, the sleeve 72, with the rod 24 extending through it, may be placed between dies 81 and 82 of a conventional press structure shown schematically in FIG. 3 as being located diametrically on opposite sides of the sleeve 72. The dies 81 and 82 are then forced inwardly as by hydraulic pressure.

As the hard steel sleeve 72 is forced radially inwardly by the dies 81 and 82, the ridges on the interior surface of the sleeve cold work the softer aluminum rod 24. As the sleeve 72 is forced radially inwardly toward the central axis of the aluminum rod 24, the ridges formed between the recesses or grooves 74 are forced into the relatively soft material of the rod. The force applied by the dies 81 and 82 presses the sleeve 72 radially inwardly so as to grip the rod 24 tightly and tends to "ovalize" the rod and sleeve. Thus, crimping the sleeve 72 onto the rod 24 causes the rod to be deformed by cold working it into intimate contact with the grooves or recesses 74 formed on the interior of the sleeve and provides a gripping action between the sleeve and the rod.

The indenting operation is performed in two steps. In the first step, described above, opposite sides 83 and 84 of the sleeve 72 are pressed radially inward. This causes "flash", a bulging of the sleeve 72 away from the sides 83 and 84 that were pressed. In the second step the rod 24 and the sleeve 72 are rotated 90° and the bulging sides 86 and 88 are compressed radially inwardly.

As the bulging sides 86 and 88 are pressed radially inwardly, the portion of the grooves or recesses 74 on these sides is pressed into the forestay rod 24. In addition, the previous tendency for the rod 24 to "ovalize" during the initial crimping step is offset so that the rod has the generally circular cross section shown in FIG. 4. The result is that the sleeve 72 has a nearly cylindrical outside surface with four small axially extending ridges 90, 92, 94 and 96. In addition, the grooves or recesses 74 are forced into the rod 24 to provide interference between the rod and the sides 86 and 88 of the sleeve and to provide a tight gripping action against the rod as well as indenting the ridges into the rod.

After the sleeve 72 has been crimped and the rod 24 has been cold worked into intimate engagement with the contour of the grooves or recesses 74 on the inside of the sleeve, the collar 26 (FIGS. 3 and 5) is slid outwardly along the rod until the shoulder 50 (FIG. 3) engages the end face 70 of the sleeve. The collar 26 may be secured against rotation relative to the rod 24 and the sleeve 72 by pressing a pin 100 into a hole 102 through the collar 26, the rod and the sleeve. As a final step, a suitable sealant may be applied to fill any space between the collar 26 (FIG. 5) and the rod 24 and between the rod and the plug 80.

It will be noted that the forestay rod 24 may be cut to any desired length to fit the boat 12, and the sleeve 72 may then be connected to the rod using a relatively inexpensive and simple to operate press having dies 81 and 82 (FIGS. 3 and 4). This may be done at the factory if the unit is being manufactured for a known boat but more commonly the rod will be shipped without any collars or with only one collar attached. The rod may then cut to the desired length by a retailer who can readily attach the collars or collar needed.

Because the sleeve 72 is pressed into the rod 24, the manufacturing tolerances used in extruding the rod are not as critical as they are in a coupling formed by threading a collar onto the rod. In the latter case the rod was threaded when cut to size. To assure that the rod would not be undersized for proper threading, a practice has been to extrude the rod oversized and to machine it to proper threading diameter after it is cut to the desired length. This requires more skill and machining operations to be done by the retailer or the manufacturer.

Accordingly, the present invention not only provides a strong coupling for the forestay but facilitates the custom fabrication of the forestay assembly by a retailer or distributor.

In the embodiments described a relatively soft aluminum forestay rod 24 and a hard stainless steel sleeve 72 are utilized. Internal grooves or recesses 74 are formed in the sleeve 72, and a strong joint is made by deforming the sleeve radially inward with the crests between adjacent grooves cold working the softer rod 24. However it is contemplated that the same advantageously strong type of joint in a forestay assembly could be formed between a forestay rod formed of a hard material and a sleeve formed of a soft material. In such a case an external thread would be formed on the hard rod and the softer collar would be forced radially inward.

It is further contemplated that the forestay rod 24 may be formed of graphite or plastic material rather than metal as described above. In this case the collar 72 could also be made of a plastic, non-metallic material that is harder than the rod 24, or the collar could be made of metal. In addition, regardless of what material the rod 24 is made of, the collar 72 may be made of a plastic material which is harder than the material of the rod.

The sleeve 72 may have a liner of different hardness which is bonded or otherwise fixed to the interior of the sleeve. For example, sleeve 72 may be made of a relatively hard material with a relatively soft material bonded to its inside. Such a compound sleeve 72 is attached to a rod 24 in which ridges and recesses have been formed by the applicant's indenting process. All of these embodiments of the present invention possess in common the feature that the crimping or swaging of the collar 72 onto the rod 24 eliminates the need of carefully machining mating threads and greatly facilitates installation of a stay 10 on a sailboat.

The following is claimed:

1. A method of making a stay unit for use in a sailboat, said method comprising the steps of placing a sleeve member having a load-bearing surface upon which an axial load may be applied around one end portion of a stay rod member and positioning the sleeve member so that the surface provides an abutment for a collar disposed about said rod for coupling the end portion of said rod into a stay assembly with the sleeve member preventing movement of the collar over the sleeve and off the rod at the end portion, and deforming the rod and sleeve members by pressing against the outer side surface of the sleeve to indent and force the material of the one of said members into a recessed portion of the other of said members whereby axial loads may be transmitted between the collar and the rod through said sleeve member.

2. A method as set forth in claim 1 wherein said rod member is of a relatively soft material, and said sleeve member is of relatively hard material, whereby the pressure forces the sleeve member into the rod to indent the rod and to cold form material into the recesses in said sleeve.

3. A method as set forth in claim 1 further including the step of inserting a plug into an axially extending slot in the rod member for supporting a sail at said one end portion of the rod member to position the plug inside the sleeve member prior to performing the step of deforming the rod and sleeve members.

4. A method as set forth in claim 2 further including the step of inserting a plug into an axially extending slot in the rod member for supporting a sail at said one end portion of the rod member to position the plug inside the sleeve member prior to performing the step of deforming the rod and sleeve members.

5. A method as set forth in claims 1 or 2 wherein a plurality of alternating grooves and ridges internally of the sleeve member and extending transverse to the longitudinal axis of the rod member indents the rod member to form a plurality of spaced grooves and ridges therein.

6. A method as set forth in claim 2 wherein the rod member is of an aluminum and is indented by a steel sleeve member.

7. A method of making a stay assembly for use in a sailboat, said method comprising the steps of coaxially assembling a rod member of a relatively soft material, a sleeve member formed of a relatively hard material and having a load-bearing surface upon which an axial load may be applied around one end portion of the rod member, and a collar member having an internal shoulder adapted to abut the load-bearing surface of the sleeve member and extend beyond the sleeve from said end portion for coupling the rod into a stay assembly, simultaneously deforming the rod member and the sleeve member by pressing against the outer side surface of the sleeve member to force the material of the rod member into tight engagement with a recessed portion of the sleeve member whereby axial loads may be transmitted between the rod member and the collar member through the sleeve member and the collar member is precluded from moving off the rod member over the sleeve member.

8. A method as set forth in claim 7 wherein the rod member has a slot formed therein for receiving the bead of a sail, said method further including the step of inserting a plug into the slot in the rod member adjacent said one end portion of the rod member prior to performing said step of simultaneously deforming the rod and sleeve members.

9. A method as set forth in claim 7 wherein an aluminum rod member and a stainless sleeve member are used as the rod and sleeve members.

10. A method of manufacturing a stay unit having a metal stay rod, and a collar encompassing one end portion of said rod for coupling the end of the rod into a stay assembly, said method comprising the steps of positioning a sleeve on said one end portion of the rod to be inside said collar to provide an abutment limiting movement of said collar outwardly of said end portion, and cold forming the metal of the rod into transverse recesses in the interior surface of the sleeve to permanently attach the sleeve to the rod.

11. A method as set forth in claim 10 wherein the metal stay rod has a slot adapted to receive the bead of a sail and further including the step of supporting the side walls of the slot in the rod against the forces imposed during said steps of applying pressure and cold forming by inserting a plug which at least partially fills the slot at said one end portion of the rod.

* * * * *